US012281794B1

(12) United States Patent
DiCintio

(10) Patent No.: US 12,281,794 B1
(45) Date of Patent: Apr. 22, 2025

(54) COMBUSTOR BODY AND AXIAL FUEL STAGE IMMERSED INJECTORS ADDITIVELY MANUFACTURED WITH DIFFERENT MATERIALS

(71) Applicant: GE Infrastructure Technology LLC, Greenville, SC (US)

(72) Inventor: Richard Martin DiCintio, Simpsonville, SC (US)

(73) Assignee: GE Infrastructure Technology LLC, Greenville, SC (US)

( * ) Notice: Subject to any disclaimer, the term of this patent is extended or adjusted under 35 U.S.C. 154(b) by 0 days.

(21) Appl. No.: 18/399,840

(22) Filed: Dec. 29, 2023

(51) Int. Cl.
*F23R 3/34* (2006.01)
*F23R 3/28* (2006.01)

(52) U.S. Cl.
CPC ..... *F23R 3/346* (2013.01); *F23R 3/283* (2013.01); *F23R 2900/00012* (2013.01); *F23R 2900/00018* (2013.01)

(58) Field of Classification Search
CPC .. F23R 3/283; F23R 3/34; F23R 3/346; F23R 2900/00018; F23R 2900/03341
See application file for complete search history.

(56) References Cited

U.S. PATENT DOCUMENTS

| | | | |
|---|---|---|---|
| 5,383,766 | A | 1/1995 | Przirembel et al. |
| 5,813,836 | A | 9/1998 | Starkweather |
| 6,047,550 | A | 4/2000 | Beebe |
| 6,192,688 | B1 | 2/2001 | Beebe |
| 6,206,638 | B1 | 3/2001 | Glynn et al. |
| 6,868,676 | B1 | 3/2005 | Haynes |
| 7,568,887 | B1 | 8/2009 | Liang |
| 7,854,591 | B2 | 12/2010 | Liang |
| 8,112,216 | B2 | 2/2012 | Davis, Jr. et al. |
| 8,167,559 | B2 | 5/2012 | Liang |
| 8,402,768 | B2 | 3/2013 | Syed et al. |
| 8,677,753 | B2 | 3/2014 | Melton et al. |
| 8,683,808 | B2 | 4/2014 | Venkataraman et al. |
| 8,701,382 | B2 | 4/2014 | Davis, Jr. et al. |

(Continued)

FOREIGN PATENT DOCUMENTS

| | | | | |
|---|---|---|---|---|
| CN | 107289460 A | * | 10/2017 | ..... F23R 3/38 |
| EP | 3232002 A1 | | 10/2017 | |

OTHER PUBLICATIONS

English translation of Chen CN107289460 (Year: 2017).*

*Primary Examiner* — Scott J Walthour
(74) *Attorney, Agent, or Firm* — James Pemrick; Charlotte Wilson; Hoffman Warnick LLC

(57) ABSTRACT

A combustor for a gas turbine system includes a combustion liner including a primary combustion zone and a secondary combustion zone. The combustor body is additively manufactured and made of a first material. The combustor also includes axial fuel stage (AFS) immersed injectors extending radially into the combustion liner in the secondary combustion zone. Each AFS immersed injector extends through an opening in the combustion liner and is additively manufactured with a second material different than the first material. A coupler fixes each AFS immersed injector in a respective opening in the combustion liner. The additive manufacturing results in as much as a 70% reduction in parts within a given combustor and allows use of high temperature and high oxidation tolerant, hot gas path (HGP) materials for the AFS immersed injectors.

16 Claims, 6 Drawing Sheets

(56) References Cited

U.S. PATENT DOCUMENTS

| | | | |
|---|---|---|---|
| 8,701,383 | B2 | 4/2014 | Venkataraman et al. |
| 8,701,418 | B2 | 4/2014 | Venkataraman et al. |
| 8,707,707 | B2 | 4/2014 | Venkataraman et al. |
| 8,931,280 | B2 | 1/2015 | Kaleeswaran et al. |
| 9,052,115 | B2 | 6/2015 | Stoia et al. |
| 9,097,424 | B2 | 8/2015 | Chen et al. |
| 9,140,455 | B2 | 9/2015 | Stoia et al. |
| 9,151,500 | B2 | 10/2015 | Chen et al. |
| 9,284,888 | B2 | 3/2016 | Romig et al. |
| 9,316,396 | B2 | 4/2016 | DiCintio et al. |
| 9,447,971 | B2 | 9/2016 | Kim et al. |
| 9,617,859 | B2 | 4/2017 | Morgan et al. |
| 9,938,903 | B2 | 4/2018 | Hughes et al. |
| 9,945,294 | B2 | 4/2018 | Hughes et al. |
| 9,945,562 | B2 | 4/2018 | Hughes et al. |
| 9,976,487 | B2 | 5/2018 | Hughes et al. |
| 9,989,260 | B2 | 6/2018 | Hughes et al. |
| 9,995,221 | B2 | 6/2018 | Hughes et al. |
| 10,006,367 | B2 | 6/2018 | Romanov et al. |
| 10,100,646 | B2 | 10/2018 | Propheter-Hinckley et al. |
| 10,220,474 | B2 | 3/2019 | Theuer et al. |
| 10,228,138 | B2 | 3/2019 | Theuer et al. |
| 10,364,681 | B2 | 7/2019 | Krumanaker et al. |
| 10,704,399 | B2 | 7/2020 | Lacy et al. |
| 10,760,430 | B2 | 9/2020 | Lacy et al. |
| 10,927,680 | B2 | 2/2021 | Lacy et al. |
| 11,021,969 | B2 | 6/2021 | Krumanaker et al. |
| 11,041,389 | B2 | 6/2021 | Lacy et al. |
| 11,187,415 | B2 | 11/2021 | Jones et al. |
| 11,371,699 | B2 | 6/2022 | Bolanos Chaverri et al. |
| 11,434,821 | B2 | 9/2022 | Wertz |
| 11,566,536 | B1 | 1/2023 | Cox |
| 11,767,766 | B1 | 9/2023 | Matthews et al. |
| 2010/0071376 | A1* | 3/2010 | Wiebe ..... F23R 3/34 60/740 |
| 2011/0056206 | A1* | 3/2011 | Wiebe ..... F23D 11/36 60/730 |
| 2019/0120064 | A1 | 4/2019 | Jennings et al. |
| 2022/0307694 | A1* | 9/2022 | Binek ..... F23R 3/346 |
| 2023/0266008 | A1* | 8/2023 | Binek ..... F23R 3/346 60/438 |

* cited by examiner 260
158

262
180

336
Memory 338
Control System 330
Code 334
Object 334O
System 334S
PU 344
348
I/O 346
I/O Device 350
Storage System 340
Code 334
310
Inert Gas 376
382
380
386
374
312
362
158,180
320
314
316
318
372
370
368
332
360

COMBUSTOR BODY AND AXIAL FUEL STAGE IMMERSED INJECTORS ADDITIVELY MANUFACTURED WITH DIFFERENT MATERIALS

TECHNICAL FIELD

The disclosure relates generally to turbomachine combustors and, more specifically, to a combustor body and axial fuel stage immersed injectors additively manufactured with different materials.

BACKGROUND

Gas turbine systems include a combustion section including a plurality of combustors in which fuel is combusted to create a flow of combusted gas that is converted to kinetic energy in a downstream turbine (e.g., an expansion turbine). Current combustors include a large number of parts that are separately manufactured and need to be assembled together, which can be a complex and time-consuming process. Additive manufacturing such as direct metal laser melting (DMLM) or selective laser melting (SLM) has emerged as a reliable manufacturing method for making parts.

In certain combustors, axial fuel stage (AFS) immersed injectors extend radially into a combustion liner to combust fuel in a secondary combustion zone downstream of a primary combustion zone. The AFS immersed injectors are used to provide a higher energy and more efficient combustor. Current AFS immersed injectors are made of the same material as other typical combustor parts. The temperature limitations of the current materials limit the application of the AFS immersed injectors. For example, the use of hydrogen fuel would not be advisable with current AFS immersed injectors because of its combustion temperature and quick reactivity.

BRIEF DESCRIPTION

All aspects, examples and features mentioned below can be combined in any technically possible way.

An aspect of the disclosure includes a combustor for a gas turbine system, the combustor comprising: a combustor body including a combustion liner including a primary combustion zone and a secondary combustion zone, wherein the combustor body is additively manufactured and made of a first material; a plurality of axial fuel stage (AFS) immersed injectors extending radially into the combustion liner in the secondary combustion zone, each AFS immersed injector extending through an opening in the combustion liner, wherein each immersed injector is additively manufactured and made of a second material different than the first material; and a coupler fixing each AFS immersed injector in a respective opening in the combustion liner.

Another aspect of the disclosure includes any of the preceding aspects, and further comprising a braze joint seal surrounding each AFS immersed injector at a surface of the combustion liner.

Another aspect of the disclosure includes any of the preceding aspects, and the coupler includes: a sleeve radially extending from an outer portion of the combustion liner at each opening in the combustion liner, each sleeve having an inner surface configured to mate with an outer surface of a respective AFS immersed injector; and a pin extending through an opening in the sleeve and an opening in a radially outer end of each AFS immersed injector.

Another aspect of the disclosure includes any of the preceding aspects, and the coupler includes a tack weld between a radially outer end of each AFS immersed injector and an outer portion of the combustion liner.

Another aspect of the disclosure includes any of the preceding aspects, and the coupler includes a threaded connection between each AFS immersed injector and the respective opening in the combustion liner.

Another aspect of the disclosure includes any of the preceding aspects, and each AFS immersed injector has a circular cross-sectional shape.

Another aspect of the disclosure includes any of the preceding aspects, and each AFS immersed injector has an airfoil cross-sectional shape.

Another aspect of the disclosure includes any of the preceding aspects, and each AFS immersed injector includes a fuel passage, an air passage, and a plurality of fuel-air nozzles spaced along a length thereof for supplying a fuel and air combustible mixture to the secondary combustion zone from the fuel passage and the air passage.

Another aspect of the disclosure includes any of the preceding aspects, and further comprising a head end fuel nozzle assembly coupled to a forward end of the combustor body for supplying a fuel and air combustible mixture to the primary combustion zone.

Another aspect of the disclosure includes a gas turbine (GT) system, comprising: a compressor section; a combustion section operatively coupled to the compressor section; and a turbine section operatively coupled to the combustion section, wherein the combustion section includes at least one combustor including: a combustor body including a combustion liner including a primary combustion zone and a secondary combustion zone, wherein the combustor body is additively manufactured and made of a first material; a plurality of axial fuel stage (AFS) immersed injectors extending radially into the combustion liner in the secondary combustion zone, each AFS immersed injector extending through an opening in the combustion liner, wherein each immersed injector is additively manufactured and made of a second material different than the first material; and a coupler fixing each AFS immersed injector in a respective opening in the combustion liner.

Another aspect of the disclosure includes any of the preceding aspects, and further comprising a braze joint seal surrounding each AFS immersed injector at a surface of the combustion liner.

Another aspect of the disclosure includes any of the preceding aspects, and the coupler includes: a sleeve radially extending from an outer portion of the combustion liner at each opening in the combustion liner, each sleeve having an inner surface configured to mate with an outer surface of a respective AFS immersed injector; and a pin extending through an opening in the sleeve and an opening in a radially outer end of each AFS immersed injector.

Another aspect of the disclosure includes any of the preceding aspects, and the coupler includes a tack weld between a radially outer end of each AFS immersed injector and an outer portion of the combustion liner.

Another aspect of the disclosure includes any of the preceding aspects, and the coupler includes a threaded connection between each AFS immersed injector and the respective opening in the combustion liner.

Another aspect of the disclosure includes any of the preceding aspects, and each AFS immersed injector has a circular cross-sectional shape.

Another aspect of the disclosure includes any of the preceding aspects, and each AFS immersed injector has an airfoil cross-sectional shape.

Another aspect of the disclosure includes any of the preceding aspects, and each AFS immersed injector includes a fuel passage, an air passage therein, and a plurality of fuel-air nozzles spaced along a length thereof for supplying a fuel and air combustible mixture to the secondary combustion zone.

Another aspect of the disclosure includes any of the preceding aspects, and further comprising a head end fuel nozzle assembly coupled to a forward end of the combustor body for supplying a fuel and air combustible mixture to the primary combustion zone.

Two or more aspects described in this disclosure, including those described in this summary section, may be combined to form implementations not specifically described herein. That is, all embodiments described herein can be combined with each other.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
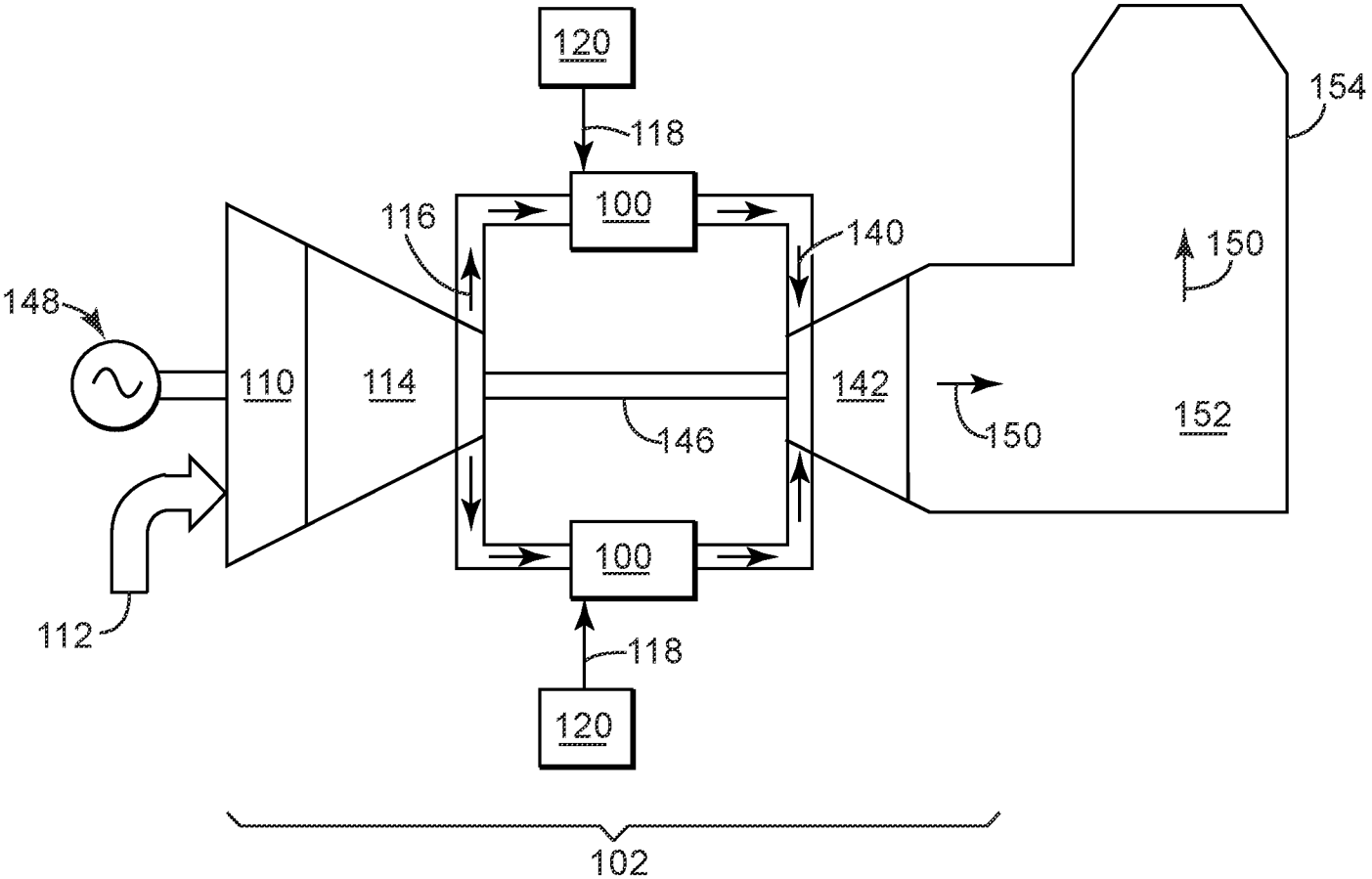
FIG. 1 shows a functional block diagram of an illustrative gas turbine system capable of use with a combustor and combustor body according to the various embodiments of the disclosure.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the subject matter of the current disclosure, it will become necessary to select certain terminology when referring to and describing relevant machine components within the illustrative application of a turbomachine. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through a combustor of the turbomachine or, for example, the flow of air through the combustor or coolant through one of the turbomachine's component systems. The term "downstream" corresponds to the direction of flow of the fluid, and the term "upstream" refers to the direction opposite to the flow. The terms "forward" and "aft," without any further specificity, refer to directions, with "forward" referring to the front or compressor end of the turbomachine, and "aft" referring to the rearward or turbine end of the turbomachine.

The term "axial" refers to movement or position parallel to an axis, e.g., an axis of a combustor or turbomachine. The term "radial" refers to movement or position perpendicular to an axis, e.g., an axis of a combustor or a turbomachine. In cases such as this, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. Finally, the term "circumferential" refers to movement or position around an axis, e.g., a circumferential interior surface of a combustion liner or a circumferential interior of casing extending about a combustor. As indicated above (and depending on context), it will be appreciated that such terms may be applied in relation to the axis of the combustor or the axis of the turbomachine.

In addition, several descriptive terms may be used regularly herein, as described below. The terms "first," "second," and "third," may be used interchangeably to distinguish one component from another and are not intended to signify location or importance of the individual components.

The terminology used herein is for the purpose of describing particular embodiments only and is not intended to be limiting of the disclosure. As used herein, the singular forms "a," an, and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event may or may not occur or that the subsequently described feature may or may not be present and that the description includes instances where the event occurs, or the feature is present and instances where the event does not occur, or the feature is not present.

Where an element or layer is referred to as being "on," "engaged to," "connected to," "coupled to," or "mounted to" another element or layer, it may be directly on, engaged, connected, coupled, or mounted to the other element or layer, or intervening elements or layers may be present. In contrast, when an element is referred to as being "directly on," "directly engaged to," "directly connected to," or "directly coupled to" another element or layer, there are no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items. The verb forms of "couple" and "mount" may be used interchangeably herein.

Embodiments of the disclosure provide a combustor for a gas turbine system. The combustor includes a combustor body that includes a combustion liner that defines a primary combustion zone and a secondary combustion zone. The combustor body is additively manufactured and made of a first material. The combustor also includes a plurality of axial fuel stage (AFS) immersed injectors extending radially into the combustion liner in the secondary combustion zone. Each AFS immersed injector extends through an opening in the combustion liner and is additively manufactured of a second material different than the first material. A coupler fixes each AFS immersed injector in the respective opening in the combustion liner. The additively manufactured combustor body and AFS immersed injectors include a plurality of parallel, sintered metal layers. The additive manufacturing results in as much as a 70% reduction in parts within a given combustor and allows use of lower cost materials for the combustor body and more expensive, high temperature and high oxidation tolerant, hot gas path (HGP) materials for the AFS immersed injectors.

FIG. 1 shows a functional block diagram of an illustrative GT system 102 that may incorporate various embodiments of a combustor 100 of the present disclosure. As shown in FIG. 1, GT system 102 generally includes an inlet section 110 that may include a series of filters, cooling coils, moisture separators, and/or other devices to purify and otherwise condition a working fluid (e.g., air) 112 entering GT system 102. Working fluid 112 flows to a compressor section 114, where compressor section 114 progressively imparts kinetic energy to working fluid 112 to produce a compressed air 116 at a highly energized state. Compressed air 116 is mixed with a fuel 118 from a fuel supply 120 to form a combustible mixture, which is ignited and burned within one or more combustors 100 to produce high-temperature combustion gases 140.

Combustion gases 140 flow through a turbine 142 (e.g., an expansion turbine) of a turbine section to produce work. For example, turbine 142 may be connected to a shaft 146 so that rotation of turbine 142 drives compressor 114 of the compressor section to produce compressed air 116. Alternately, or in addition, shaft 146 may connect turbine 142 to a generator 148 for producing electricity. Exhaust gases 150 from turbine 142 flow through an exhaust section 152 that connects turbine 142 to an exhaust stack 154 downstream from turbine 142. Exhaust section 152 may include, for example, a heat recovery steam generator (not shown) for cleaning and extracting additional heat from exhaust gases 150 prior to release to the environment.

In one embodiment, GT system 102 may include a gas turbine engine model commercially available from GE Vernova of Cambridge, MA. The present disclosure is not limited to any one particular GT system and may be implanted in connection with other engines including, for example, the other HA, F, B, LM, GT, TM and E-class engine models of GE Vernova, and engine models of other companies. Furthermore, the present disclosure is not limited to any particular turbomachine and may be applicable to, for example, steam turbines, jet engines, compressors, turbofans, etc.

Figure 2:
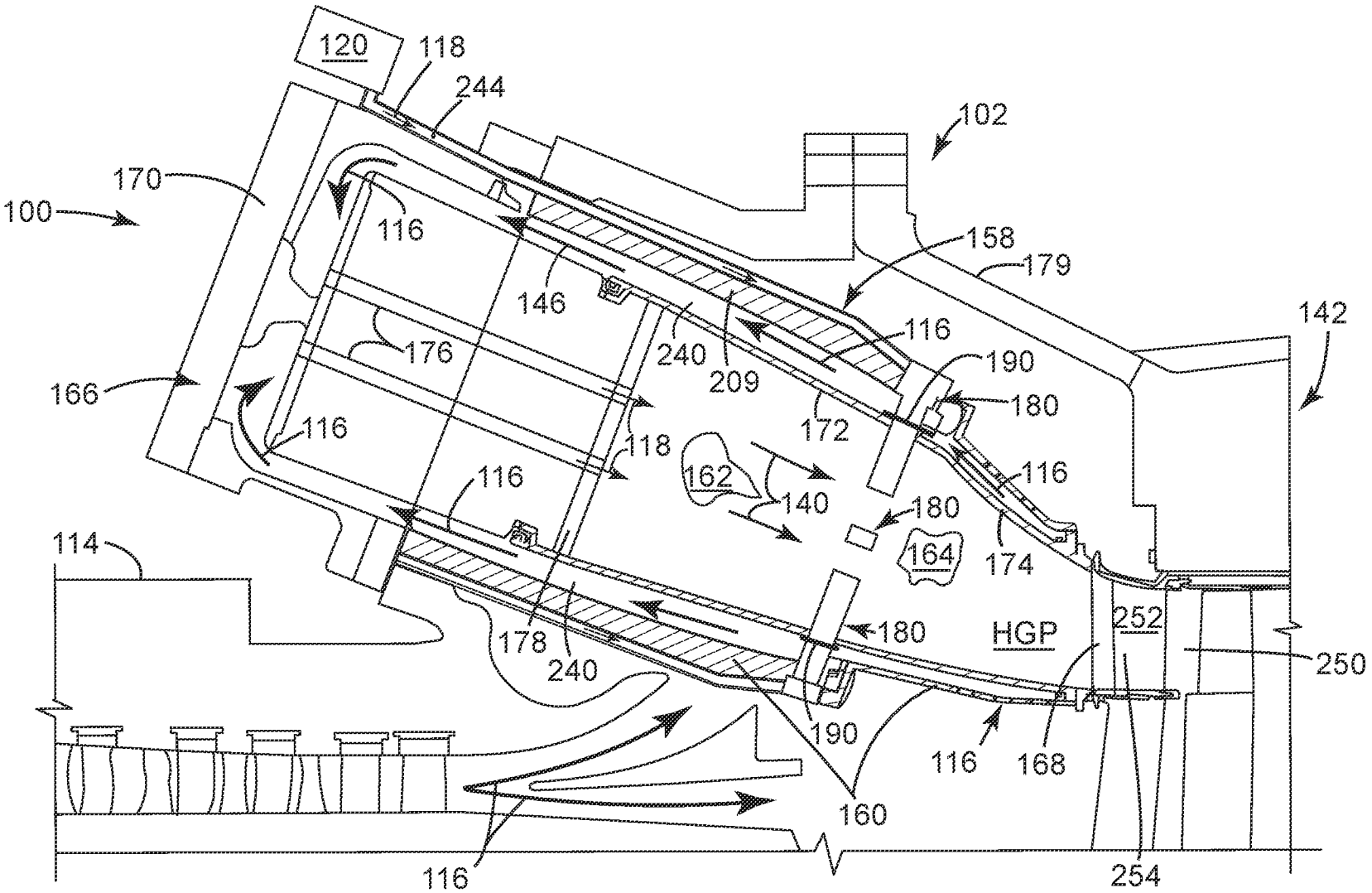
FIG. 2 shows a cross-sectional side view of a portion of a combustor with an additively manufactured combustor body and AFS immersed injectors according to embodiments of the disclosure.

FIG. 2 shows a cross-sectional view of a combustor 100 according to embodiments of the disclosure. As shown in FIG. 2, combustor 100 includes a combustor body 158 including combustion liner 160 that contains and conveys combustion gases 140 to a turbine section including turbine 142. As will be described herein, combustion liner 160 may extend between a head end fuel nozzle assembly 166 and an aft frame 168. Combustion liner 160 includes a primary combustion zone 162 and a secondary combustion zone 164. More particularly, combustion liner 160 defines a combustion chamber, within which combustion occurs in primary combustion zone 162 and secondary combustion zone 164. A combustible mixture of fuel and air is burned to produce combustion gases 140 having a high temperature and pressure.

Combustion liner 160 may have a cylindrical portion 172 and a tapered transition portion 174 integral with cylindrical portion 172, i.e., forming a unified body (or "unibody") construction. In accordance with embodiments of the disclosure, combustion liner 160 is additively manufactured with a first material. The first material may include any now known or later developed combustion tolerant and oxidation resistant materials. The first material may include but is not limited to: an austenite nickel-chromium based alloy such as a nickel-chromium-molybdenum-niobium alloy (NiCrMoNb) (e.g., Inconel 625® alloy or Inconel 718® alloy), a nickel-chromium-iron-molybdenum alloy (NiCrFeMo) (e.g., Hastelloy® X alloy available from Haynes International, Inc.), or a nickel-chromium-cobalt-molybdenum alloy (NiCrCoMo) (e.g., Haynes 282® alloy or Haynes 233® alloy available from Haynes International, Inc.), or a nickel-chromium-cobalt-titanium (NiCrCoTi) alloy (e.g., GTD262® alloy developed by General Electric Company).

Combustor 100 may include head end fuel nozzle assembly 166 (hereafter "head end assembly 166") coupled to a forward end of combustor body 158 for supplying fuel and air combustible mixture to primary combustion zone 162. Head end fuel nozzle assembly 166 may include any now known or later developed fuel nozzle assembly for delivering fuel 118 to primary combustion zone 162 from axially extending fuel nozzles 176. Head end assembly 166 generally includes at least one axially extending fuel nozzle 176 that extends downstream from end cover 170 and a cap assembly 178 that extends radially and axially within combustion liner 160 downstream from end cover 170 and that defines the upstream boundary of the combustion chamber.

Figure 3:
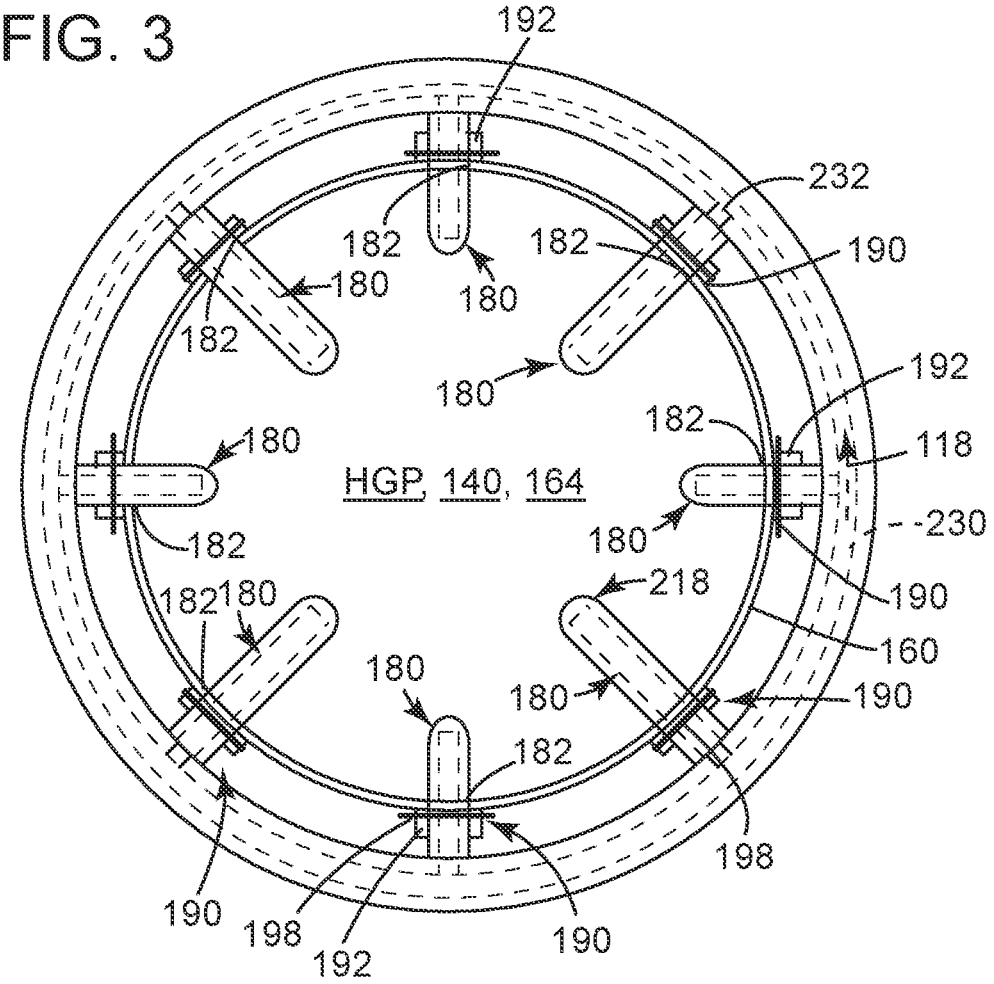
FIG. 3 shows a cross-sectional end view of a plurality of AFS immersed injectors according to embodiments of the disclosure.

Combustor 100 also includes a plurality of axial fuel stage (AFS) immersed injectors 180 extending radially through and into combustion liner 160 in secondary combustion zone 164. FIG. 3 shows an end view of AFS immersed injectors 180 in combustion liner 160. With reference to FIGS. 2 and 3, each AFS immersed injector 180 extends through an opening 182 in combustion liner 160. The injectors are referred to as "immersed" because they extend into secondary combustion zone 164 and combustion gases 140 therein. Hence, they are immersed in secondary combustion zone 164 and combustion gases 140 therein. The AFS immersed injectors 180 may have different lengths (e.g., in an alternating arrangement as shown in FIG. 3) or may have a common length (not shown).

Each AFS immersed injector 180 is additively manufactured and made of a second material different from the first material, i.e., of combustor body 158. AFS immersed injectors 180 may include a metal that is typically used in a hot gas path (HGP) component such as a turbine 142 blade or nozzle and that has a higher temperature and higher oxidation tolerance than first material used for combustor body 158. The metal may be a pure metal or an alloy. The second material may include a non-reactive metal powder, i.e., from a non-explosive or non-conductive powder, such as but not limited to: a cobalt chromium molybdenum (CoCrMo) alloy, stainless steel, an austenite nickel-chromium based alloy such as a nickel-chromium-molybdenum-niobium alloy (NiCrMoNb) (e.g., Inconel 625® alloy or Inconel 718® alloy), a nickel-chromium-iron-molybdenum alloy (NiCrFeMo) (e.g., Hastelloy® X alloy available from Haynes International, Inc.), or a nickel-chromium-cobalt-molybdenum alloy (NiCrCoMo) (e.g., Haynes 282® alloy available from Haynes International, Inc.). Other possibilities include, for example, Rend 108® alloy, CM 247 LC® alloy, Mar M 247® alloy, and any precipitation harden-able (PH) nickel alloy.

Figure 4:
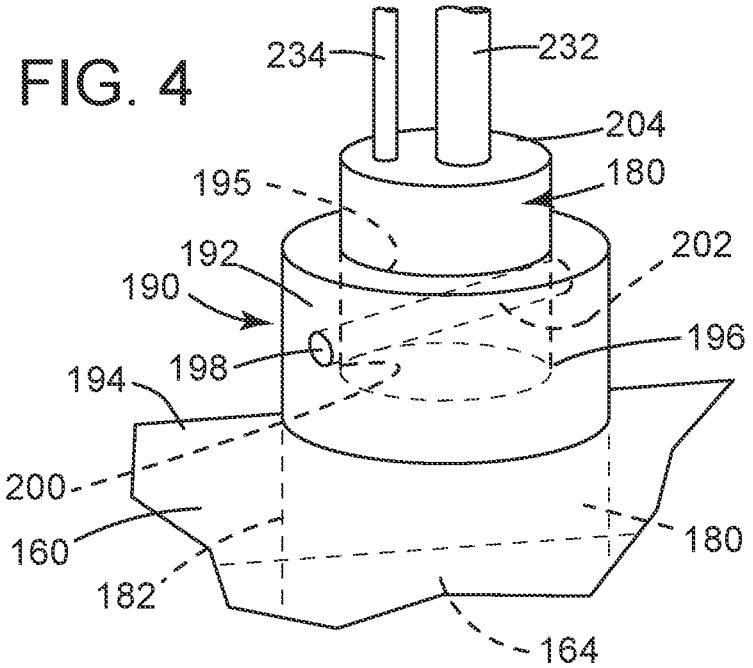
FIG. 4 shows a perspective view of a radially outer end of an AFS immersed injector according to embodiments of the disclosure.

Combustor 100 also includes a coupler 190 fixing each AFS immersed injector 180 in a respective opening 182 in combustion liner 160. FIG. 4 shows a perspective view of a radially outer end of a coupler 190 according to one embodiment of the disclosure. In certain embodiments, coupler 190 includes a sleeve 192 radially extending from an outer portion 194 of combustion liner 160 at each opening 182 of combustion liner 160. Each sleeve 192 may have an inner surface 195 configured to mate with an outer surface 196 of a respective AFS immersed injector 180, i.e., have the same cross-sectional shape. Sleeve 192 may be co-extensive with opening 182 in combustion liner 160. Coupler 190 may further include a pin 198 extending through an opening 200 in sleeve 192 and an opening 202 in a radially outer end 204 of AFS immersed injector 180. In this manner, pin 198 fixedly secures AFS immersed injector 180 in opening 182. That is, AFS immersed injector 180 cannot move relative to opening 182. Pin 198 can be any form of mechanical fixation mechanism, e.g., a threaded fastener, interference fit pin, etc., capable of securing AFS immersed injector 180 in place in sleeve 192 and opening 182 in combustion liner 160.

Figure 5:
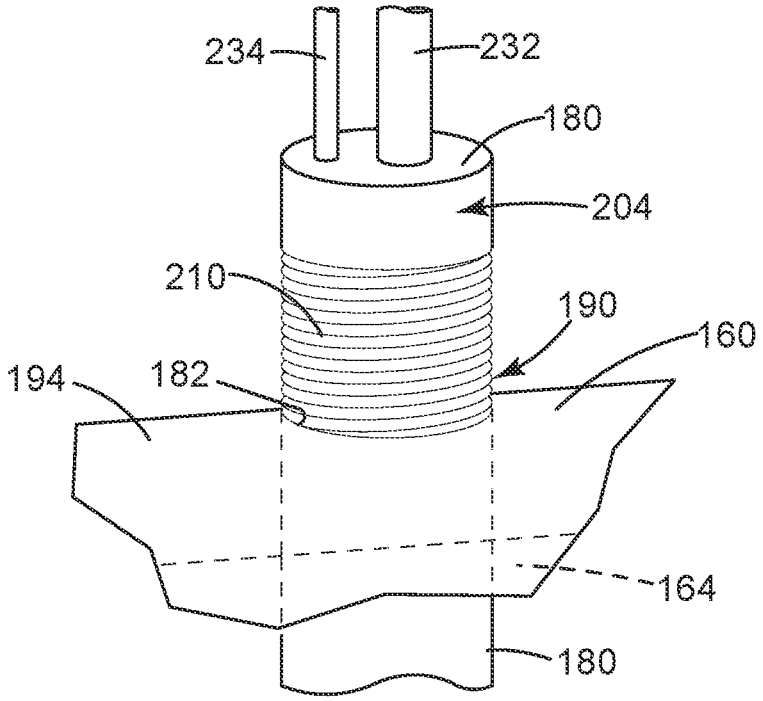
FIG. 5 shows a perspective view of a radially outer end of an AFS immersed injector according to other embodiments of the disclosure.
Figure 6:
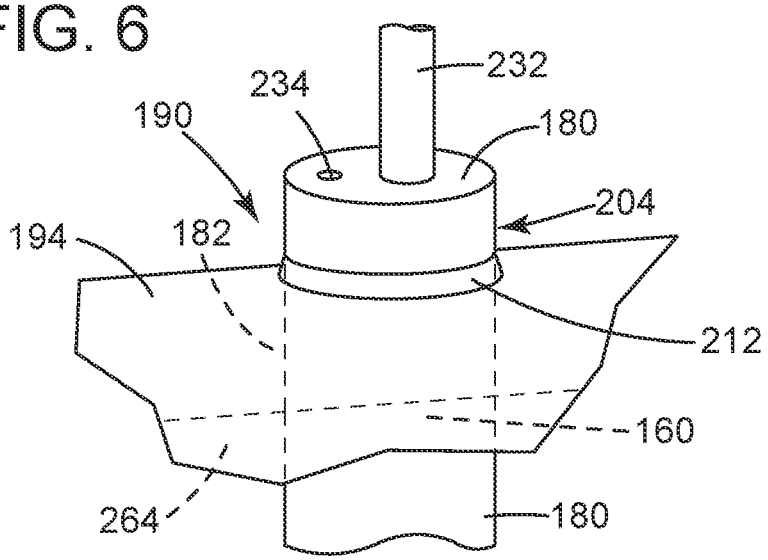
FIG. 6 shows a perspective view of a radially outer end of an AFS immersed injector according to additional embodiments of the disclosure.

Coupler 190 can take other forms also. FIG. 5 shows a perspective view of a radially outer end of a coupler 190 according to another embodiment. In FIG. 5, coupler 190 includes a threaded connection 210 between each AFS immersed injector 180 and respective opening 182 in combustion liner 160, i.e., with mating threaded fasteners. In this case, AFS immersed injector 180 may have radially outer end 204 (surface) thereof with threads thereon configured to mate with threads on an inner surface of opening 182. A threaded arrangement could also be used with sleeve 192 in the FIG. 4 embodiment rather than pin 198. Coupler 190 with a threaded connection may have any thread tolerance sufficient to prevent leakage from the hot gas path (HGP) within combustion liner 160. FIG. 6 shows a perspective view of a radially outer end of a coupler 190 according to another embodiment. In FIG. 6, coupler 190 includes a tack weld 212 between radially outer end 204 of each AFS immersed injector 180 and outer portion 194 of combustion liner 160, i.e., at or around opening 182.

Figure 7:
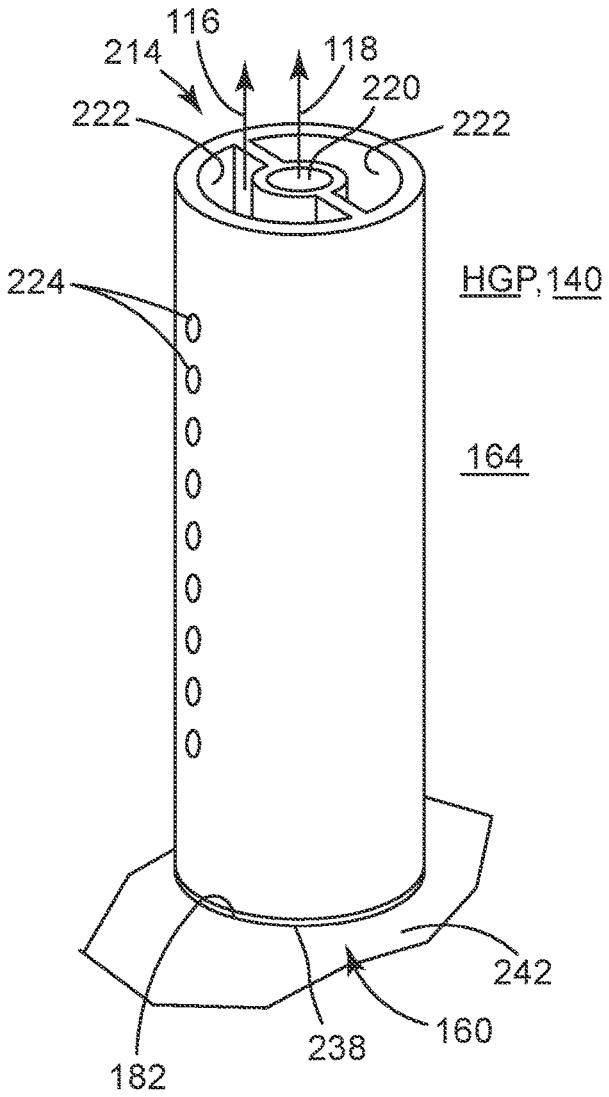
FIG. 7 shows a perspective view of an AFS immersed injector with the radially inner end thereof cross-sectioned according to embodiments of the disclosure.
Figure 8:
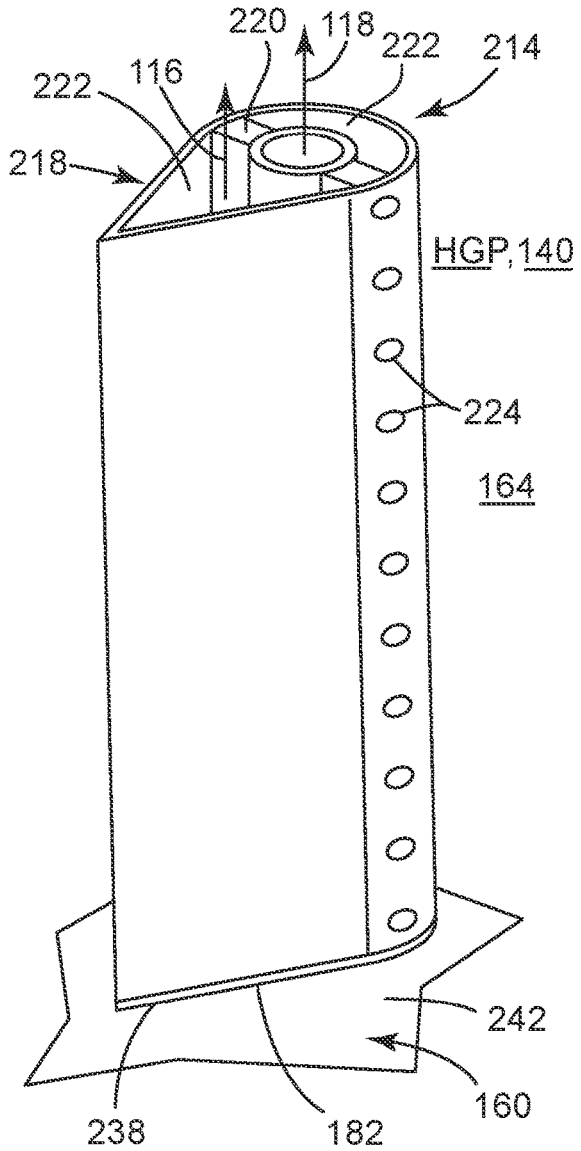
FIG. 8 shows a perspective view of an AFS immersed injector with the radially inner end thereof cross-sectioned according to other embodiments of the disclosure.

FIG. 7 shows a perspective view of one embodiment of an AFS immersed injector 180, and FIG. 8 shows a perspective view of another embodiment of an AFS immersed injector 180. In FIGS. 7 and 8, a radially inner end 214 of each AFS immersed injector 180 is shown in cross-section to show illustrative internal configurations for the injectors. Radially inner end 214 can have any manner of terminal shape, e.g., rounded (see FIG. 3), planar, etc. In FIG. 7, AFS immersed injector 180 has a circular cross-sectional shape, and in FIG. 8, AFS immersed injector 180 has an airfoil cross-sectional shape, e.g., a symmetric airfoil. Other cross-sectional shapes are also possible.

As shown in FIGS. 7 and 8, each AFS immersed injector 180 includes one or more fuel passages 220, one or more air passages 222, and a plurality of fuel-air nozzles 224 spaced along a length thereof for supplying fuel and air combustible mixture to secondary combustion zone 164 from fuel passage(s) 220 and air passage(s) 222. In general, compressed air 116 from air passage(s) 222 is directed through fuel 118 from fuel passage(s) 220 and out of nozzles 224 into secondary combustion zone 164. As understood in the art, the passages 220, 222 and nozzle 224 arrangements can take a variety of forms depending on factors such as but not limited to: fuel characteristics (e.g., flow rate, combustibility, reactivity, pressure, temperature, etc.), other combustor physical characteristics (e.g., combustion zone volume), and/or air characteristics (e.g., flow rate, pressure, temperature, etc.). Accordingly, it is emphasized that the passage and nozzle arrangements shown are merely illustrative.

As the possible arrangements are known in the art, no further details are provided so the reader can focus on the salient parts of the disclosure. The previously described fuel-air passage arrangement assumes a pre-mixing of fuel and air. It will be recognized that, in other embodiments, fuel passage(s) or air passage(s) may be omitted. For example, for highly reactive fuels (e.g., hydrogen), the direct injection of fuel into combustion liner 160 may improve combustion without additional air input. In other cases, air only may be warranted to improve combustion. In these cases, one or the other of fuel passage(s) 220 and air passage(s) 222 would be omitted and nozzles 224 would inject only air or fuel into combustion liner 160. Alternately, fuel may be delivered from one set of nozzles or orifices, and air may be delivered from another set of nozzles or orifices proximate to the one set of nozzles or orifices.

FIG. 3 shows a circular fuel plenum 230 with radially extending passages 232 for delivering fuel 118, e.g., natural or propane gas, to AFS immersed injectors 180. However, fuel 118 can be delivered in any now known or later developed fashion. Compressed air 116 can also be delivered to AFS immersed injectors 180 in any now known or later developed manner, e.g., as shown in FIGS. 3-6, through passages 234 in radially outer ends 204 of the injectors 180.

In certain embodiments, as shown in FIGS. 7 and 8, combustor 100 may also include a braze joint seal 238 surrounding each AFS immersed injector 180 at a surface 242 (e.g., an inner surface) of combustion liner 160. The braze material may include any appropriate material capable of the required wetting and environmental resistance in secondary combustion zone 164. Alternately, or additionally, a braze joint seal may be formed on the outer surface of the combustion liner 160 (e.g., similar to tack weld 212 shown in FIG. 6).

Referring again to FIG. 2, combustor body 158 may also include an air flow passage 240 provided in combustion liner 160 or, as an alternative, may include a flow sleeve (not shown) spaced from and surrounding a portion of combustion liner 160. Air flow passage 240 at least partially surrounds at least cylindrical portion 172 of combustion liner 160. Air flow passage 240 routes compressed air 116 across an outer surface of combustion liner 160 (cylindrical portion 172 and/or tapered transition portion 174). In addition, air flow passage 240 may extend along tapered transition portion 174 and may route at least a portion of compressed air 116 to the one or more radially extending AFS immersed injectors 180 to combine with fuel for combustion in a secondary combustion zone 164 that is downstream from primary combustion zone 162. In addition, as shown in FIG. 2, fuel passages 244 extending along or in combustion liner 160 (or along or in a fuel sleeve not shown) may deliver fuel to AFS immersed injectors 180 from fuel supply 120. Note the fuel to head end assembly 166 and AFS immersed injectors 180 can be different, e.g., liquid fuel to head end assembly 166 and gas fuel to AFS immersed injectors 180.

Combustors 100 generally terminate at a point that is adjacent to a first stage 250 of stationary nozzles 252 of turbine 142. First stage 250 of stationary nozzles 252 at least partially defines a turbine inlet 254 to turbine 142. As noted, combustion liner 160 at least partially defines the HGP for routing combustion gases 140 from primary combustion zone 162 and secondary combustion zone 164 to turbine inlet 254 of turbine 142 during operation of GT system 102.

In operation, compressed air 116 flows from compressor 114 and is routed through air flow passage(s) 240. A portion of compressed air 116 is routed to head end assembly 166 of combustor 100 where it reverses direction and is directed through axially extending fuel nozzle(s) 176. Compressed air 116 is mixed with fuel to form a first combustible mixture that is injected into primary combustion zone 162. The first combustible mixture is burned to produce combustion gases 140. A second portion of compressed air 116 may be routed through the radially extending AFS immersed injectors 180 where it is mixed with fuel 118 from fuel passages 244 to form a second combustible mixture. The second combustible mixture is injected through combustion liner 160 and into the HGP. The second combustible mixture at least partially mixes with combustion gases 140 and is burned in secondary combustion zone 164. As noted, combustion liner 160 defines the HGP for routing combustion gases 140 from primary combustion zone 162 and secondary combustion zone 164 to turbine inlet 254 of turbine 142 during operation of GT system 102.

Figures 9, 10, 11:
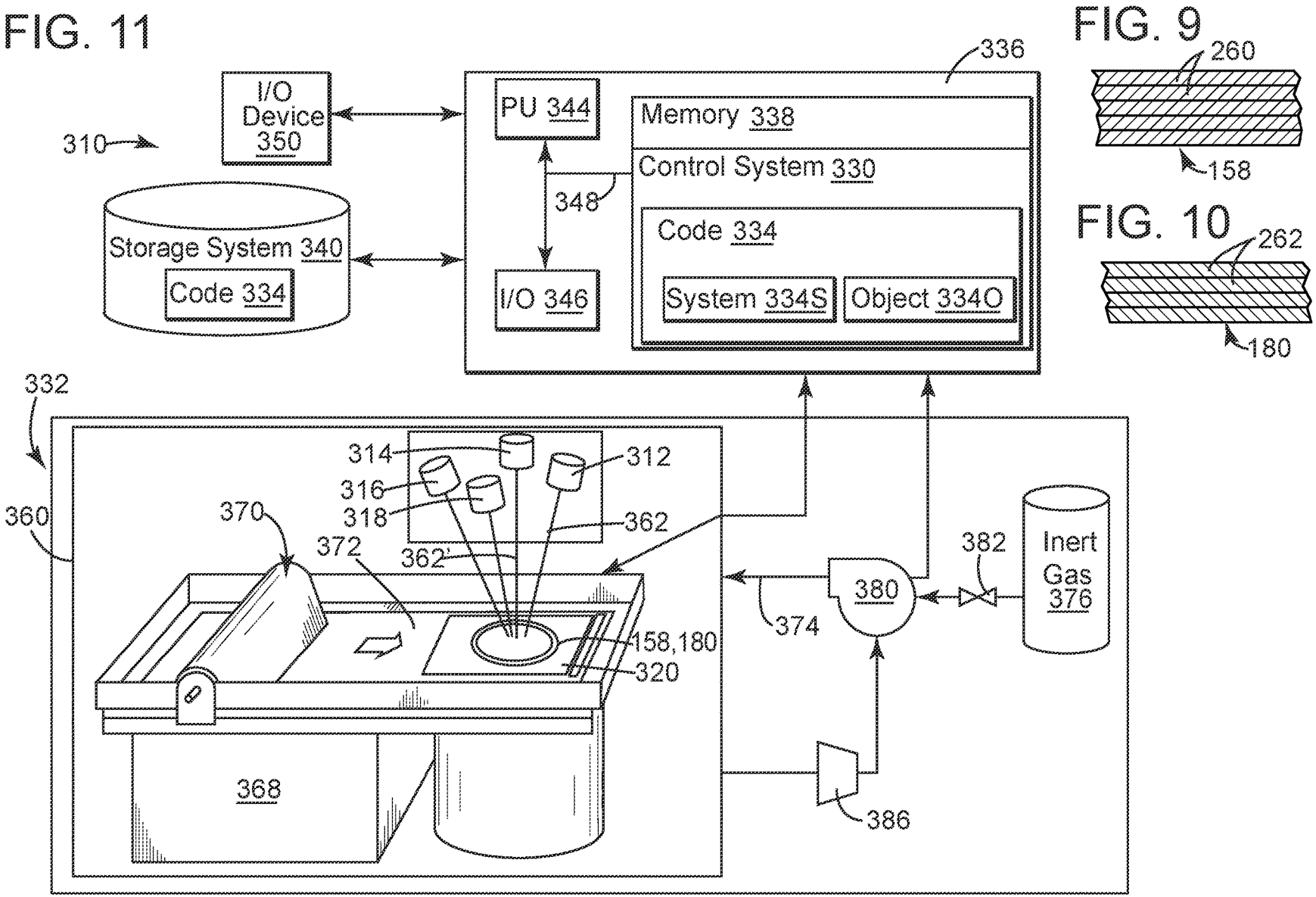
FIG. 9 shows a cross-sectional view of a plurality of parallel, sintered metal layers of a combustor body according to embodiments of the disclosure.
FIG. 10 shows a cross-sectional view of a plurality of parallel, sintered metal layers of an AFS immersed injector according to embodiments of the disclosure.
FIG. 11 shows a schematic block diagram of an illustrative additive manufacturing system for additively manufacturing a combustor body according to the various embodiments of the disclosure.

Combustor body 158 and each AFS immersed injector 180 may be additively manufactured using any now known or later developed technique capable of forming the large, integral body. Consequently, as shown in FIG. 9, combustor body 158 includes a plurality of parallel, sintered metal layers 260 of first material, and, as shown in FIG. 10, each AFS immersed injector 180 includes a plurality of parallel, sintered metal layers 262 of second material. FIG. 11 shows a schematic/block view of an illustrative computerized metal powder additive manufacturing system 310 (hereinafter 'AM system 310') for generating combustor body 158 and/or AFS immersed injectors 180, of which only a single layer is shown. The teachings of the disclosures will be described relative to building combustor body 158 and/or AFS immersed injectors 180 using multiple melting beam sources 312, 314, 316, 318, but it is emphasized and will be readily recognized that the teachings of the disclosure are equally applicable to build combustor body 158 and/or AFS immersed injectors 180 using any number of melting beam sources.

In this example, AM system 310 is arranged for direct metal laser melting (DMLM). It is understood that the general teachings of the disclosure are equally applicable to other forms of metal powder additive manufacturing such as but not limited to selective laser melting (SLM), and perhaps other forms of additive manufacturing (i.e., other than metal powder applications). The layer of combustor body 158 and/or AFS immersed injectors 180 in build platform 320 is illustrated in FIG. 11 as a circular element; however, it is understood that the additive manufacturing process can be readily adapted to manufacture any shaped part of combustor body 158 and/or AFS immersed injectors 180 on build platform 320.

AM system 310 generally includes an additive manufacturing control system 330 ("control system") and an AM printer 332. As will be described, control system 330 executes a set of computer-executable instructions or code 334 to generate combustor body 158 and/or AFS immersed injectors 180 using multiple melting beam sources 312, 314, 316, 318. In the example shown, four melting beam sources may include four lasers. However, the teachings of the disclosures are applicable to any melting beam source, e.g., an electron beam, laser, etc. Control system 330 is shown implemented on computer 336 as computer program code. To this extent, computer 336 is shown including a memory 338 and/or storage system 340, a processor unit (PU) 344, an input/output (I/O) interface 346, and a bus 348. Further, computer 336 is shown in communication with an external I/O device/resource 350.

In general, processor unit (PU) 344 executes computer program code 334 that is stored in memory 338 and/or storage system 340. While executing computer program code 334, processor unit (PU) 344 can read and/or write data to/from memory 338, storage system 340, I/O device 350 and/or AM printer 332. Bus 348 provides a communication link between each of the components in computer 336, and I/O device 350 can comprise any device that enables a user to interact with computer 336 (e.g., keyboard, pointing device, display, etc.).

Computer 336 is only representative of various possible combinations of hardware and software. For example, processor unit (PU) 344 may comprise a single processing unit or be distributed across one or more processing units in one or more locations, e.g., on a client and server. Similarly, memory 338 and/or storage system 340 may reside at one or more physical locations. Memory 338 and/or storage system 340 can comprise any combination of various types of non-transitory computer readable storage medium including magnetic media, optical media, random access memory (RAM), read only memory (ROM), etc. Computer 336 can comprise any type of computing device such as an industrial controller, a network server, a desktop computer, a laptop, a handheld device, etc.

As noted, AM system 310 and, in particular, control system 330 executes code 334 to generate combustor body 158 and/or AFS immersed injectors 180. Code 334 can include, among other things, a set of computer-executable instructions 334S (herein also referred to as 'code 334S') for operating AM printer 332 as a system and a set of computer-executable instructions 334O (herein also referred to as 'code 334O') for defining respective objects, such as combustor body 158 and/or AFS immersed injectors 180 to be physically generated by AM printer 332. As described herein, additive manufacturing processes begin with a non-transitory computer readable storage medium (e.g., memory 338, storage system 340, etc.) storing code 334. Set of computer-executable instructions 334S for operating AM printer 332 may include any now known or later developed software code capable of operating AM printer 332.

The set of computer-executable instructions 334O defining combustor body 158 and/or AFS immersed injectors 180 may include a precisely defined 3D model of combustor body 158 and/or AFS immersed injectors 180 and can be generated from any of a large variety of well-known computer aided design (CAD) software systems such as AutoCAD®, TurboCAD®, DesignCAD 3D Max™, etc. In this regard, code 334O can include any now known or later developed file format. Furthermore, code 334O representative of combustor body 158 and/or AFS immersed injectors 180 may be translated between different formats. For example, code 334O may include Standard Tessellation Language (STL) files, which were created for stereolithography CAD programs of 3D Systems, or an additive manufacturing file (AMF), which is an American Society of Mechanical Engineers (ASME) standard that is an extensible markup-language (XML) based format designed to allow any CAD software to describe the shape and composition of any three-dimensional object to be fabricated on any AM printer. Code 334O representative of combustor body 158 and/or AFS immersed injectors 180 may also be converted into a set of data signals and transmitted, received as a set of data signals and converted to code, stored, etc., as necessary. Code 334O may be configured according to embodiments of the disclosure to allow for formation of border and internal sections in overlapping field regions, as will be described. In any event, code 334O may be an input to AM system 310 and may come from a part designer, an intellectual property (IP) provider, a design company, the operator or owner of AM system 310, or from other sources. In any event, control system 330 executes code 334S and 334O, dividing combustor body 158 and/or AFS immersed injectors 180 into a series of thin slices assembled using AM printer 332 in successive layers of material.

AM printer 332 may include a processing chamber 360 that is sealed to provide a controlled atmosphere for combustor body 158 and/or AFS immersed injectors 180 printing. A build platform 320, upon which combustor body 158 and/or AFS immersed injectors 180 is/are built, is positioned within processing chamber 360. A number of melting beam sources 312, 314, 316, 318 are configured to melt layers of metal powder on build platform 320 to generate combustor body 158 and/or AFS immersed injectors 180. While four melting beam sources 312, 314, 316, 318 are illustrated, it is emphasized that the teachings of the disclosure are applicable to a system employing any number of sources, e.g., 1, 2, 3, or 5 or more. As understood in the field, each melting beam source 312, 314, 316, 318 may have a field including a non-overlapping field region, respectively, in which it can exclusively melt metal powder and may include at least one overlapping field region in which two or more sources can melt metal powder. In this regard, each melting beam source 312, 314, 316, 318 may generate a melting beam, respectively, that fuses particles for each slice, as defined by code 334O.

For example, in FIG. 11, melting beam source 312 is shown creating a layer of combustor body 158 (or AFS immersed injector 180) using melting beam 362 in one region, while melting beam source 314 is shown creating a layer of combustor body 158 (or AFS immersed injector 180) using melting beam 362' in another region. Each melting beam source 312, 314, 316, 318 is calibrated in any now known or later developed manner. That is, each melting beam source 312, 314, 316, 318 has had its laser or electron beam's anticipated position relative to build platform 320 correlated with its actual position in order to provide an individual position correction (not shown) to ensure its individual accuracy. In one embodiment, each of plurality melting beam sources 312, 314, 316, 318 may create melting beams, e.g., 362, 362', having the same cross-sectional dimensions (e.g., shape and size in operation), power and scan speed.

Continuing with FIG. 11, an applicator (or re-coater blade) 370 may create a thin layer of raw material 372 spread out as the blank canvas from which each successive slice of the final combustor body 158 and/or AFS immersed injectors 180 will be created. Various parts of AM printer 332 may move to accommodate the addition of each new layer, e.g., a build platform 320 may lower and/or chamber 360 and/or applicator 370 may rise after each layer. The process may use different raw materials in the form of fine-grain metal powder, a stock of which may be held in a chamber or powder reservoir 368 accessible by applicator 370.

Processing chamber 360 is filled with an inert gas such as argon or nitrogen and controlled to minimize or eliminate oxygen. Control system 330 is configured to control a flow of a gas mixture 374 within processing chamber 360 from a source of inert gas 376. In this case, control system 330 may control a pump 380 and/or a flow valve system 382 for inert gas to control the content of gas mixture 374. Flow valve system 382 may include one or more computer controllable valves, flow sensors, temperature sensors, pressure sensors, etc., capable of precisely controlling flow of the particular gas. Pump 380 may be provided with or without valve system 382. Where pump 380 is omitted, inert gas may simply enter a conduit or manifold prior to introduction to processing chamber 360. Source of inert gas 376 may take the form of any conventional source for the material contained therein, e.g., a tank, reservoir, or other source. Any sensors (not shown) required to measure gas mixture 374 may be provided. Gas mixture 374 may be filtered using a filter 386 in a conventional manner.

In operation, build platform 320 with metal powder thereon is provided within processing chamber 360, and control system 330 controls flow of gas mixture 374 within processing chamber 360 from source of inert gas 376. Control system 330 also controls AM printer 332, and in particular, applicator 370 and melting beam sources 312, 314, 316, 318 to sequentially melt layers of metal powder on build platform 320 to generate combustor body 158 and/or AFS immersed injectors 180 according to embodiments of the disclosure. While a particular AM system 310 has been described herein, it is emphasized that the teachings of the disclosure are not limited to any particular additive manufacturing system or method.

Once combustor body 158 and/or AFS immersed injectors 180 is formed, as shown in FIG. 2, it may be assembled with other parts of combustor 100 and/or connected to turbine inlet 254. For example, head end assembly 166 may be coupled to a forward end of combustor body 158. Head end assembly 166 may be coupled in any now known or later developed fashion, such as welding or fasteners. In addition, turbine inlet 254 may be coupled to aft frame 168. Aft frame 168 may be coupled to turbine inlet 254 in any now known or later developed fashion, such as welding or fasteners. AFS injectors 180 may be coupled to couplers 190, as illustrated in FIGS. 4-8 and as discussed above, such that the AFS injectors 180 extend radially inward into the combustion chamber.

The disclosure provides various technical and commercial advantages, examples of which are discussed herein. The additive manufactured combustor body lowers the costs of the combustor by eliminating the need to manufacture so many parts and then assemble the parts. As a result, the additive manufacturing results in as much as a 70% reduction in parts within a final combustor. The additive manufacturing also allows use of high temperature and high oxidation tolerant, hot gas path (HGP) materials for the AFS immersed injectors and lower cost materials for the combustor body. Moreover, additive manufacturing allows the formation of complex internal flow passages for air and fuel within the AFS immersed injectors for promoting cooling and/or pre-mixing of the fuel and air.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately" or "about," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiments were chosen and described in order to best explain the principles of the disclosure and the practical application of the technology and to enable others of ordinary skill in the art to understand the disclosure for contemplating various modifications to the present embodiments, which may be suited to the particular use contemplated.

What is claimed is:

1. A combustor for a gas turbine system, the combustor comprising:

a combustor body including a combustion liner including a primary combustion zone and a secondary combustion zone, wherein the combustor body is additively manufactured and made of a first material;

a plurality of axial fuel stage (AFS) immersed injectors extending radially into the combustion liner in the secondary combustion zone, each AFS immersed injector extending through an opening in the combustion liner, wherein each AFS immersed injector is additively manufactured and made of a second material different than the first material; and a coupler fixing each AFS immersed injector in a respective opening in the combustion liner, wherein the coupler includes:

a sleeve radially extending from an outer portion of the combustion liner at each opening in the combustion liner, each sleeve having an inner surface configured to mate with an outer surface of a respective AFS immersed injector, and a mechanical fixation mechanism extending through each of an opening in the sleeve and an opening in a radially outer end of each AFS immersed injector, the opening in the radially outer end of each AFS immersed injector extending through the radially outer end of each AFS immersed injector.

2. The combustor of claim 1, further comprising a braze joint seal surrounding each AFS immersed injector at a surface of the combustion liner.

3. The combustor of claim 1, wherein the mechanical fixation mechanism includes an interference fit pin.

4. The combustor of claim 1, wherein the coupler includes a tack weld between a radially outer end of each AFS immersed injector and an outer portion of the combustion liner.

5. The combustor of claim 1, wherein each AFS immersed injector has a circular cross-sectional shape.

6. The combustor of claim 1, wherein each AFS immersed injector has an airfoil cross-sectional shape.

7. The combustor of claim 1, wherein each AFS immersed injector includes a fuel passage, an air passage, and a plurality of fuel-air nozzles spaced along a length of the AFS immersed injector, for supplying a fuel and air combustible mixture to the secondary combustion zone from the fuel passage and the air passage.

8. The combustor of claim 1, further comprising a head end fuel nozzle assembly coupled to a forward end of the combustor body for supplying a fuel and air combustible mixture to the primary combustion zone.

9. A gas turbine (GT) system, comprising:

a compressor section;

a combustion section operatively coupled to the compressor section; and a turbine section operatively coupled to the combustion section, wherein the combustion section includes at least one combustor including:

a combustor body including a combustion liner including a primary combustion zone and a secondary combustion zone, wherein the combustor body is additively manufactured and made of a first material;

a plurality of axial fuel stage (AFS) immersed injectors extending radially into the combustion liner in the secondary combustion zone, each AFS immersed injector extending through an opening in the combustion liner, wherein each AFS immersed injector is additively manufactured and made of a second material different than the first material; and a coupler fixing each AFS immersed injector in a respective opening in the combustion liner, wherein the coupler includes:

a sleeve radially extending from an outer portion of the combustion liner at each opening in the combustion liner, each sleeve having an inner surface configured to mate with an outer surface of a respective AFS immersed injector; and a mechanical fixation mechanism extending through each of an opening in the sleeve and an opening in a radially outer end of each AFS immersed injector, the opening in the radially outer end of each AFS immersed injector extending through the radially outer end of each AFS immersed injector.

10. The GT system of claim 9, further comprising a braze joint seal surrounding each AFS immersed injector at a surface of the combustion liner.

11. GT system of claim 9, wherein the mechanical fixation mechanism includes an interference fit pin.

12. The GT system of claim 9, wherein the coupler includes a tack weld between a radially outer end of each AFS injector and an outer portion of the combustion liner.

13. The GT system of claim 9, wherein each AFS immersed injector has a circular cross-sectional shape.

14. The GT system of claim 9, wherein each AFS immersed injector has an airfoil cross-sectional shape.

15. The GT system of claim 9, wherein each AFS immersed injector includes a fuel passage, an air passage therein, and a plurality of fuel-air nozzles spaced along a length of the AFS immersed injector, for supplying a fuel and air combustible mixture to the secondary combustion zone.

16. The GT system of claim 9, further comprising a head end fuel nozzle assembly coupled to a forward end of the combustor body for supplying a fuel and air combustible mixture to the primary combustion zone.

* * * * *